US008139988B2

(12) United States Patent
Moon et al.

(10) Patent No.: US 8,139,988 B2
(45) Date of Patent: Mar. 20, 2012

(54) DEVELOPING DEVICE OF IMAGE FORMING APPARATUS

(75) Inventors: Ji Won Moon, Anyang-si (KR); Ki Jae Do, Suwon (KR); Seung Gweon Lee, Suwon-Si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/555,102

(22) Filed: Sep. 8, 2009

(65) Prior Publication Data

US 2010/0104325 A1 Apr. 29, 2010

(30) Foreign Application Priority Data

Oct. 24, 2008 (KR) ..... 10-2008-0104511

(51) Int. Cl.
*G03G 15/08* (2006.01)

(52) U.S. Cl. ..... 399/260; 399/119

(58) Field of Classification Search ..... 399/119, 399/252, 254–256, 258–260, 262–263
See application file for complete search history.

(56) References Cited

U.S. PATENT DOCUMENTS

| | | | | |
|---|---|---|---|---|
| 4,647,180 | A * | 3/1987 | Watanabe | 399/258 |
| 5,508,792 | A * | 4/1996 | Ishida et al. | 399/256 |
| 5,517,286 | A * | 5/1996 | Tada et al. | 399/274 |
| 5,842,090 | A * | 11/1998 | Mikawa | 399/256 |
| 5,995,789 | A * | 11/1999 | Murakami et al. | 399/262 |
| 6,510,300 | B2 * | 1/2003 | Mizoguchi et al. | 399/106 |
| 6,671,481 | B1 * | 12/2003 | Terry et al. | 399/258 |
| 2005/0100366 | A1 | 5/2005 | Kim et al. | |
| 2005/0281581 | A1 * | 12/2005 | Kitozaki | 399/111 |
| 2006/0018673 | A1 | 1/2006 | Choi | |
| 2007/0025773 | A1 | 2/2007 | Tateyama et al. | |

FOREIGN PATENT DOCUMENTS

| | | | |
|---|---|---|---|
| JP | 04340984 | A * | 11/1992 |
| JP | 1998-239970 | | 9/1998 |
| JP | 2001175082 | | 6/2001 |
| KR | 20060103077 | | 9/2006 |
| KR | 20060111134 | | 10/2006 |

OTHER PUBLICATIONS

European Search Report issued Feb. 2, 2010 in EP Application No. 09171348.7.

* cited by examiner

*Primary Examiner* — David Porta
*Assistant Examiner* — Benjamin Schmitt
(74) *Attorney, Agent, or Firm* — Stanzione & Kim, LLP

(57) ABSTRACT

A developing device includes a feed tool to feed a developer to a developing tool, a developer receiving chamber in which the developer to be fed to the feed tool is received, and a first delivery unit and a second delivery unit arranged one higher than another in a state in which the developing device is mounted in the image forming apparatus. The developer received in the developer receiving chamber is delivered to the second delivery unit by the first delivery unit and thereafter, is delivered to the feed tool by the second delivery unit.

28 Claims, 11 Drawing Sheets

DEVELOPING DEVICE OF IMAGE FORMING APPARATUS

CROSS-REFERENCE TO RELATED APPLICATIONS

This application claims the benefit of Korean Patent Application No. 2008-0104511, filed on Oct. 24, 2008, in the Korean Intellectual Property Office, the disclosure of which is incorporated herein by reference.

BACKGROUND

1. Field of the Invention

The present general inventive concept relates to a developing device, and, more particularly, to a developing device having an improved developer delivery configuration.

2. Description of the Related Art

Image forming apparatuses are used to form an image on a printing medium according to input signals. Examples of image forming apparatuses may include printers, copiers, facsimiles, etc., and devices combining functions thereof.

In an electro-photographic image forming apparatus, which is one type of image forming apparatus, light is irradiated to a photoconductor charged with a predetermined electric potential to form an electrostatic latent image on a surface of the photoconductor, and a developer is fed to the electrostatic latent to form a visible image. The visible image, formed on the photoconductor, is transferred to a printing medium directly, or by way of an intermediate transfer unit. After being transferred to the printing medium, the image is fixed to the printing medium via a fixing process.

Conventionally, a developing device includes a developer receiving chamber in which a developer to be fed to the photoconductor is stored, and a feed tool and developing tool provided in proximity to the developer receiving chamber. The feed tool feeds the developer stored in the developer receiving chamber to the developing tool, and the developing tool attaches the developer to the surface of the photoconductor on which the electrostatic latent image is formed so as to form a visible image.

SUMMARY

Therefore, at lease one feature of embodiments of the present general inventive concept is to provide a developing device having an improved developer delivery configuration.

Additional aspects and/or utilities of the present general inventive concept will be set forth in part in the description which follows and, in part, will be obvious from the description, or may be learned by practice of the present general inventive concept.

The foregoing and/or other aspects and utilities of the present general inventive concept can be achieved by the provision of a developing device to be mounted in an image forming apparatus including: a feed tool to feed a developer to a developing tool via a frictional charging force; a developer receiving chamber in which the developer to be fed to the feed tool is received; and a first delivery unit and a second delivery unit arranged so that the first delivery unit is higher than the second delivery unit in a state in which the developing device is mounted in a body of the image forming apparatus, wherein the developer received in the developer receiving chamber is delivered to the second delivery unit by the first delivery unit and is delivered to the feed tool by the second delivery unit.

The developing device may further include a partition to divide the developer receiving chamber into a first developer receiving chamber and a second developer receiving chamber, and the first delivery unit and second delivery unit may be provided higher and lower than the partition, respectively.

The partition may include a first partition portion provided between the first delivery unit and the second delivery unit, and a second partition portion extending substantially downward from the first partition portion.

The developing device may further include an inlet formed in the first partition portion, and the developer delivered by the first delivery unit may be fed to the second delivery unit through the inlet.

The first partition portion may substantially surround a lower part of the first delivery unit.

The inlet may be formed at an end of the partition portion.

The first delivery unit may include a spiral delivery blade to deliver the developer to the inlet and a radial delivery blade to return a part of the developer that does not enter the inlet.

The inlet of the partition may be located lower than a nip region between the feed tool and the developing tool.

The developing device may further include a shield member to selectively shield the inlet of the partition.

The second partition portion may limit return of the developer to be delivered from the first delivery unit to the second delivery unit.

In a state in which the developing device is mounted in the body of the image forming apparatus, a bottom plane of the first developer receiving chamber may be inclined, causing the developer received in the first developer receiving chamber to be concentrated on a side of the partition opposite to the first developer receiving chamber.

In a state in which the developing device is mounted in the body of the image forming apparatus, the bottom plane of the first developer receiving chamber may have an inclination angle in the range of approximately 2 degrees to approximately 5 degrees.

The developing device may further include a feed member provided in the first developer receiving chamber to deliver a part of the developer received in the first developer receiving chamber upward, so as to feed the developer to the first delivery unit.

The second delivery unit may include a first circulating auger and a second circulating auger, and the developing device may further include a circulating wall provided between the first circulating auger and the second circulating auger and having communication holes formed at opposite sides thereof.

The foregoing and/or other aspects and utilities of the present general inventive concept may also be achieved by providing a developer feeding method of a developing device including a feed tool to feed a developer to a developing tool and a developer receiving chamber in which the developer to be fed to the feed tool is received, the method including: delivering a part of the developer received in the developer receiving chamber upward; causing free fall of the developer delivered upward; and feeding the fallen developer to the feed tool.

The developing device may include a first delivery unit and a second delivery unit arranged so that the first delivery unit is higher than the second delivery unit in a state in which the developing device is mounted in an image forming apparatus.

The developing device may further include a partition to divide the developer receiving chamber into a first developer receiving chamber and a second developer receiving chamber, and the first delivery unit and second delivery unit may be provided higher and lower than the partition, respectively.

The developing device may further include an inlet formed in a side of the partition, and the developer delivered upward in the direction of gravity may be delivered to the inlet of the partition by the first delivery unit and may be delivered to the second delivery unit through the inlet.

The foregoing and/or other aspects and utilities of the present general inventive concept may also be achieved by providing a developing device of an image forming apparatus including a first delivery unit to deliver developer to a feed tool, and a second delivery unit to deliver developer to a point higher than the first delivery unit.

At least part of the developer delivered by the second delivery unit may fall toward the first delivery unit.

The developing device may further include a partition between the first and second delivery units.

At least one inlet may be provided in the partition, and at least part of the developer may fall to the first delivery unit through the at least one inlet.

The developing device may further include a developer moving portion provided at the second delivery unit to move the developer delivered by the second delivery unit toward the at least one inlet.

The developing device may further include a return part provided at the second delivery unit to return a portion of the developer that does not fall to the first delivery unit.

The foregoing and/or other aspects and utilities of the present general inventive concept may also be achieved by providing a method of delivering developer in a developing device to a feed tool of the developing device, the method including delivering the developer to a point higher than a first developer delivering unit using a second developer delivering unit, and delivering at least a portion of the developer delivered by the second developer delivering unit to the feet tool using the first developer delivering unit.

The developer delivered by the second developer delivering unit may fall toward the first developer delivering unit.

The method may further include regulating a flow of the developer that falls toward the first developer delivering unit with a flow regulating member disposed between the first and second developer delivering units.

Other advantages and salient features of the present general inventive concept will become apparent from the following detailed description, which, taken in conjunction with the annexed drawings, discloses preferred embodiments of the present general inventive concept.

BRIEF DESCRIPTION OF THE DRAWINGS

These and/or other features and advantages of the present general inventive concept will become apparent and more readily appreciated from the following description of the embodiments, taken in conjunction with the accompanying drawings of which.

DETAILED DESCRIPTION OF THE EMBODIMENTS

Figure 1:
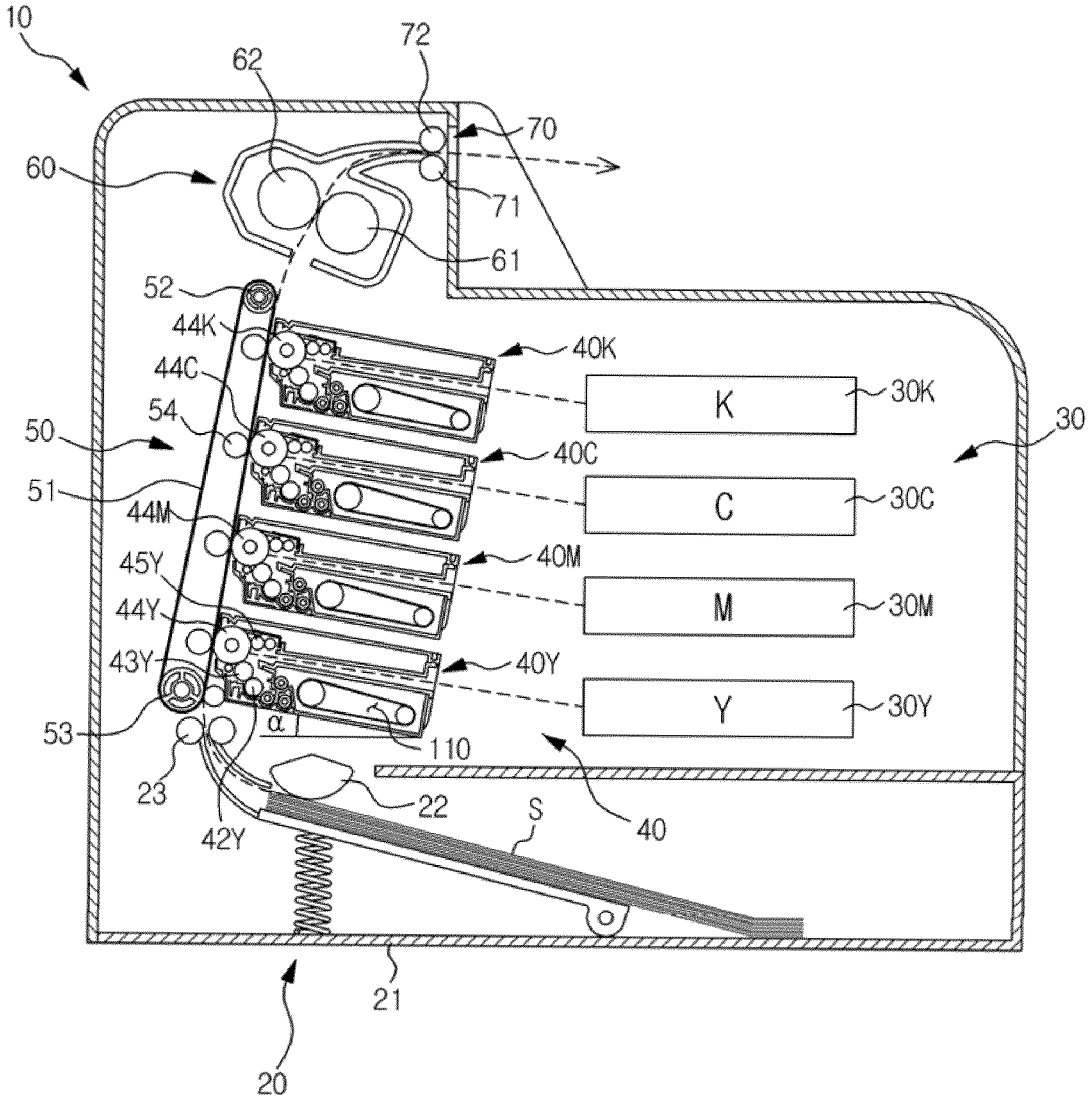
FIG. 1 is a sectional view illustrating an image forming apparatus in accordance with an embodiment of the present general inventive concept.

Reference will now be made in detail to various embodiments of the present general inventive concept, examples of which are illustrated in the accompanying drawings, wherein like reference numerals refer to like elements throughout. The embodiments are described below to explain the present general inventive concept by referring to the figures.

FIG. 1 is a sectional view illustrating an image forming apparatus in accordance with an embodiment of the present general inventive concept.

The image forming apparatus includes a body 10, a printing medium supply unit 20, a light scanning unit 30, a developing unit 40, a transfer unit 50, a fixing unit 60, and a printing medium discharge unit 70.

The body 10 defines an exterior appearance of the image forming apparatus and supports a variety of constituent elements installed therein.

The printing medium supply unit 20 may include a cassette 21 in which printing media S may be stored, a pickup roller 22 to pick up the printing media S stored in the cassette 21 sheet by sheet, and a delivery roller 23 to deliver the picked-up printing medium S toward the transfer unit 50.

The light scanning unit 30 irradiates light, corresponding to image information of colors including yellow (Y), magenta (M), cyan (C) and black (K), from light scanning devices 30Y, 30M, 30C and 30K to photoconductors 44Y, 44M, 44C and 44K of developing devices 40Y, 40M, 40C and 40K that will be described hereinafter, according to print signals, thereby causing electrostatic latent images to be formed on the respective photoconductors 44Y, 44M, 44C and 44K.

The developing unit 40 may include the four developing devices 40Y, 40M, 40C and 40K, in which different colors of developers, for example, yellow (Y), magenta (M), cyan (C) and black (K) developers are received respectively. Although the developing device 40Y in which a yellow developer (Y) is received will be described hereinafter by way of example, it will be appreciated that the following description may be applied to the other three developing devices 40M, 40C and 40K, in which magenta (M), cyan (C) and black (K) developers are received respectively, although these are not specially mentioned in the description of the developing device 40Y.

The developing device 40Y may include a developer receiving chamber 110, a feed tool 42Y, a developing tool 43Y, and the photoconductor 44Y.

The developer receiving chamber 110 stores the developer to be fed to the photoconductor 44Y, and the feed tool 42Y feeds the developer stored in the developer receiving chamber 110 to the developing tool 43Y using a frictional charging force. The developing tool 43Y attaches the developer to a surface of the photoconductor 44Y on which an electrostatic latent image is formed via the light scanning unit 30, so as to form a visible image. The developing device of the present embodiment has an improved developer delivery configuration suitable to achieve enhanced print quality and effective developer use. This improved developer delivery configuration will be described later in more detail.

The developing device 40Y may further include a charging roller 45Y to charge the photoconductor 44Y with a predetermined electric potential before the light scanning unit 30 irradiates light onto the photoconductor 44Y.

In FIG. 1, the transfer unit 50 may include a printing medium delivery belt 51 rather than an intermediate transfer belt, a driving roller 53 or 52 and a driven roller 52 or 53, and a plurality of transfer rollers 54 located inside a perimeter of the paper delivery belt 51. The transfer rollers 54 are arranged opposite to the respective photoconductors 44 and function to transfer the developers from the photoconductors 44 onto paper.

The fixing unit 60 may include a heating roller 61 having a heater, and a press roller 62 arranged opposite the heating roller 61. When the printing medium S passes between the heating roller 61 and the press roller 62, an image is fixed to the printing medium S by heat transmitted from the heating roller 61 and pressure acting between the heating roller 61 and the press roller 62.

The printing medium discharge unit 70 may include a printing medium discharge roller 71 and a backup roller 72 and serves to discharge the printing medium, having passed through the fixing unit 60, out of the body 10.

Figure 2:
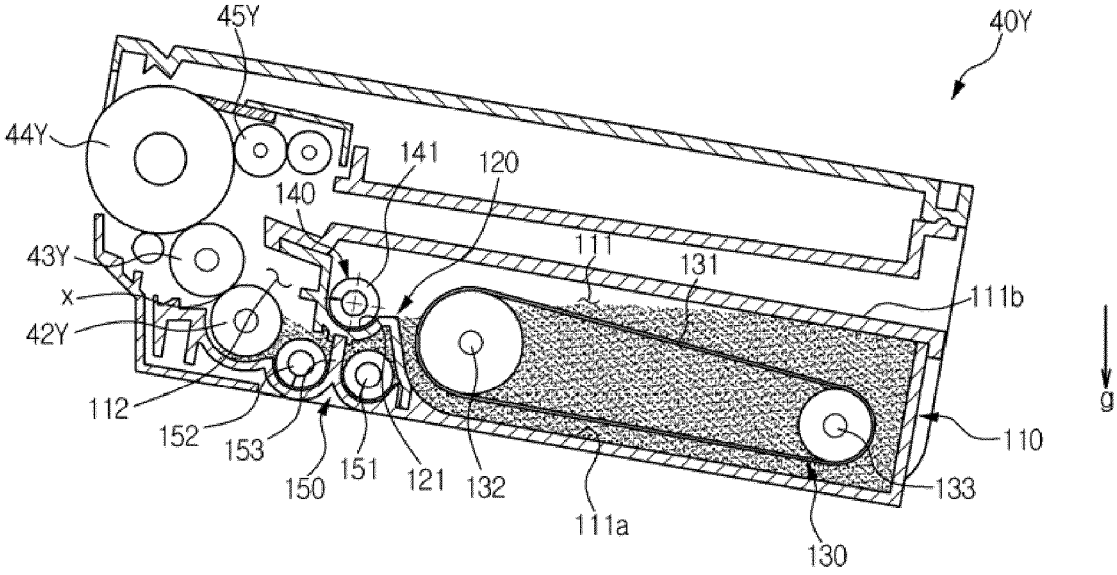
FIG. 2 is a sectional view illustrating a developing device in accordance with the embodiment of FIG. 1.

FIG. 2 is a sectional view illustrating the developing device 40Y in accordance with the embodiment of FIG. 1.

As shown in FIG. 2, the developer receiving chamber 110 of the developing device 40Y may be divided into a first developer receiving chamber 111 and a second developer receiving chamber 112 by a partition 120. The first developer receiving chamber 111 and second developer receiving chamber 112 may have access to one another through an inlet 122 (see FIG. 7) provided in a side position of the partition 120. An upper end of the partition 120 may contact a top plate 111*b* of the developing device, and a lower end of the partition 120 may contact a bottom plane 111*a* of the developing device.

The developing device 40Y in accordance with the present embodiment may further include a developer delivery member 130, a feed auger 140 located above the inlet 122 of the partition 120, and an agitating member 150 located under the inlet 122 of the partition 120.

Figure 3:
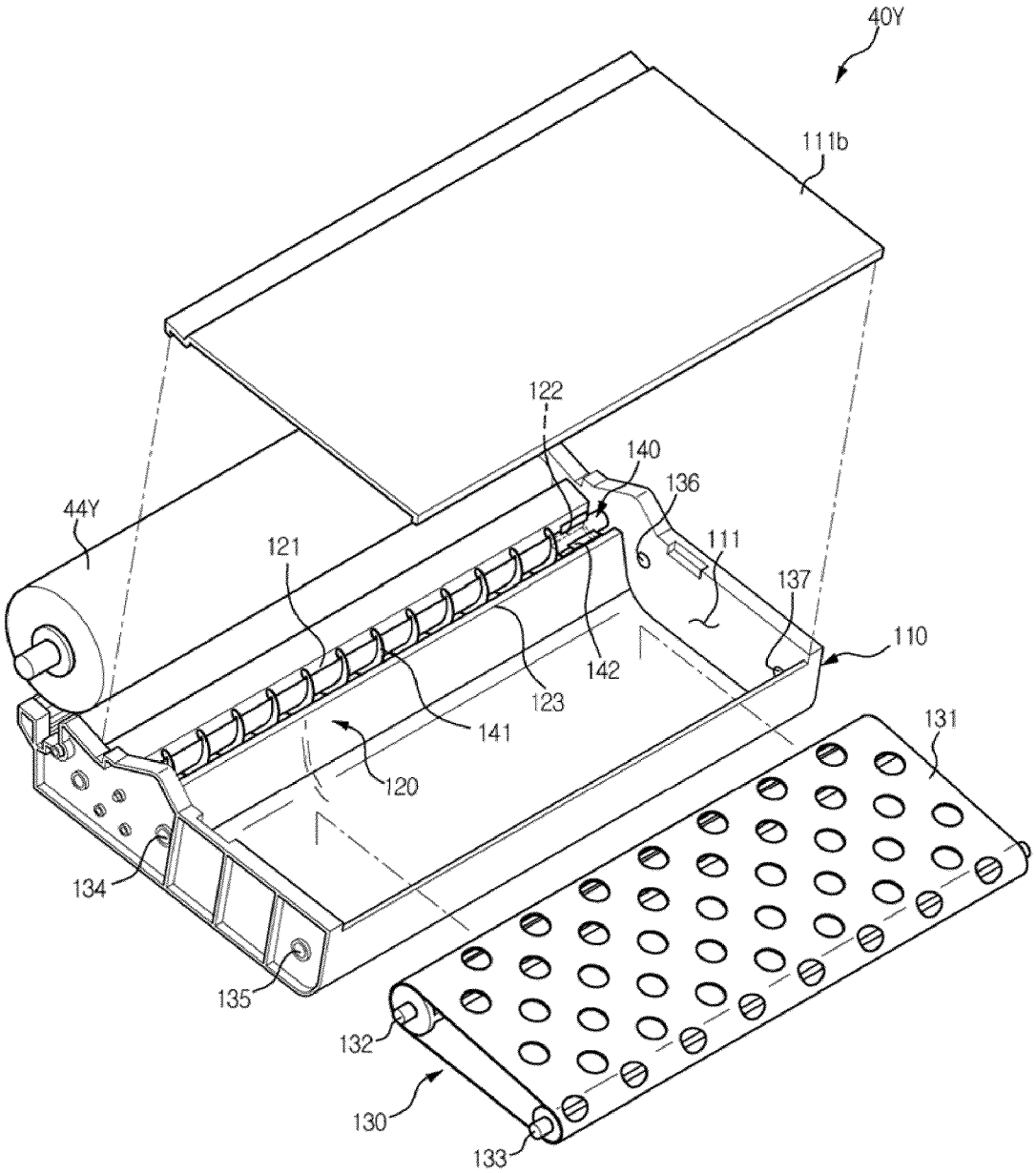
FIG. 3 is a perspective view illustrating a first developer receiving chamber of the developing device in accordance with the embodiment of FIG. 1.
Figure 4:
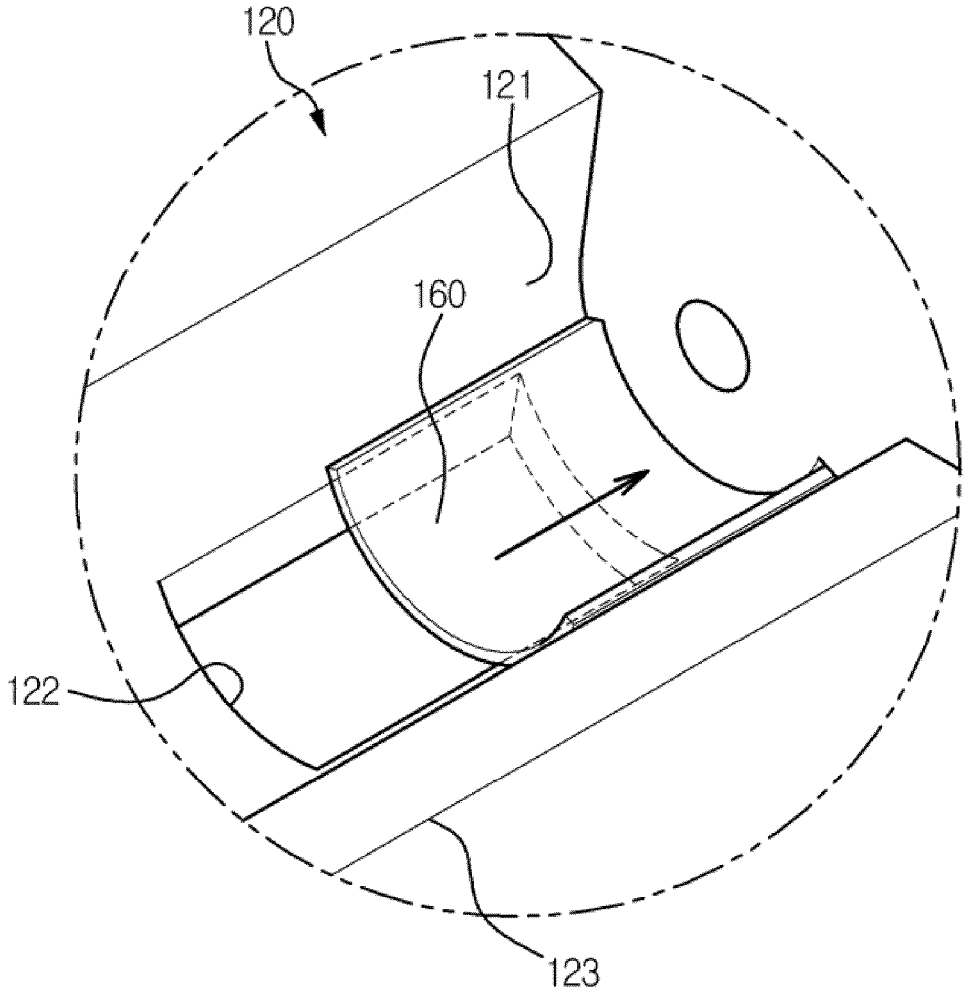
FIG. 4 is an enlarged perspective view illustrating an inlet perforated in a partition in accordance with the embodiment of FIG. 1.

FIG. 3 is a perspective view illustrating the first developer receiving chamber 110 of the developing device 40Y in accordance with the embodiment of FIG. 1, and FIG. 4 is an enlarged perspective view illustrating the inlet 122 provided in the partition 120 in accordance with the embodiment of FIG. 1.

As shown in FIG. 3, the developer delivery member 130 may include a delivery belt 131 and a pair of drive shafts 132 and 133 to drive the delivery belt 131. The developer delivery member 130 may serve not only to agitate the developer stored in the first developer receiving chamber 111, but also to deliver a part of the developer stored in the first developer receiving chamber 111 in the direction of the second developer receiving chamber 112. For example, the developer may be moved upward relative to a gravitational force (referred to herein as gravity) on the developer. Reference numerals 134, 135, 136 and 137 indicate shaft holes, through which the respective drive shafts 132 and 133 of the developer delivery member 130 are fastened. Here, of the two drive shafts, the center of the drive shaft 132, which is located in closer proximity to the feed auger 140, is ideally located lower than a rotating center of the feed auger 140 in the direction of gravity. In other words, the rotating center of the feed auger 140 may be provided at a higher position in the developing device 40Y than the center of the drive shaft 132. In addition, a rotator located on the drive shaft 132 in closer proximity to the feed auger 140 may have a larger rotating radius than a rotating radius of a rotator located on the drive shaft 133 that is located farther from the feed auger 140. The drive shaft 132 that is located in closer proximity to the feed auger 140 may be positioned higher than the drive shaft 133 that is farther from the feed auger 140 in the direction of gravity. This arrangement enables efficient adjustment of a feed amount of the developer.

Now, one of the possible features enabled by the developer delivery member 130 using the delivery belt 131 will be described. Conventionally, a plurality of agitators are substantially horizontally arranged toward the feed tool, to feed a developer to the feed tool. In a color image forming apparatus wherein a plurality of developing devices are substantially vertically arranged one above another similar to the present embodiment of the present general inventive concept, it may be necessary to reduce a height of each developing device for the purpose of reducing the overall height of the image forming apparatus, and this has an essential relation with reduction in a rotating radius of the agitators within the developing device. However, the smaller the rotating radius of the agitators, the smaller a rotating radius of the developer being delivered and consequently, the smaller a delivery span of the developer. In other words, the smaller the height of the developing device, the smaller the rotating radius of the agitators, and there is a need for a sufficient number of agitators for efficient delivery of the developer. However, feeding the developer through the use of a great number of agitators applies serious stress to the developer. Further, an increased number of agitators results in a complicated configuration including a complicated drive force transmission mechanism to drive the agitators. Therefore, provided that the delivery belt 131 is used to feed the developer according to the present embodiment, there is no need for the conventional plurality of agitators. Although the developing device has a reduced height as a result of such a configuration, the developing device assures rotation of the pair of drive shafts 132 and 133, thus resulting in a simplified configuration. In addition, elimination of the complicated drive force transmission mechanism prevents stress of the developer.

As shown in FIGS. 3 and 4, the partition 120, by which the first developer receiving chamber 111 and second developer receiving chamber 112 are separated from each other, may include a developer temporary storage portion 121 provided at the bottom of the feed auger 140. The inlet 122 may be provided in a portion of the developer temporary storage portion 121. In this embodiment, the developer temporary storage portion 121 is a U-shaped curved portion having a concave upper surface.

The developer delivered in the direction of the second developer receiving chamber 112, in this example upward relative to gravity, in the first developer receiving chamber 111 by the developer delivery member 130 may be fed to the developer temporary storage portion 121 (see FIG. 2) and then falls from the developer temporary storage portion 121 into the second developer receiving chamber 112 through the inlet 122. In this case, to prevent the developer that is fed into the second developer receiving chamber 112 from accumulating higher than a nip region x between the feed tool 42Y and the developing tool 43Y, the inlet 122 of the partition 120 may be located lower than the nip region x between the feed tool 42Y and the developing tool 43Y (see FIG. 2) in the direction of gravity (g).

The inlet 122 may have a rectangular or elliptical shape and may be located close to a longitudinal distal end of the rotating feed auger 140. However, there are various possibilities regarding the location, shape, and/or quantity of the inlet 122. For example, in a case in which the feed auger 140 is replaced by a mixing agitator or any other delivery member having a feed function, only one inlet 122 may be provided, or the inlet 122 may take the form of a longitudinally extending slit. As another example, a configuration wherein a plurality of slits are provided and longitudinally spaced apart from one another is also possible.

In the present embodiment, the feed tool or the developing tool may take the form of a cylindrical roller wherein a conductive shaft is centrally located and a conductive rubber roller portion surrounds the periphery of the conductive shaft. However, the present general inventive concept is not limited to the roller shape, and in other similar embodiments, a belt type or brush type is also applicable. The feed tool and developing tool are arranged opposite each other and are rotated while defining the nip region therebetween. Specifically, the feed tool and developing tool are rotated in opposite directions on the basis of the nip region, generating frictional charging force to frictionally charge the developer, thus allowing the developer to be delivered to the developing tool. Of course, appropriate DC power may be applied to the feed tool and developing tool to electrically charge the developer, in addition to using the frictional charging force. If DC power is applied, an absolute value of power applied to the developing tool is ideally smaller than an absolute value of power applied to the feed tool, for easy electrical charging of the developer.

To prevent an excessive amount of the developer from being fed to the developer temporary storage portion 121, a defining portion 123 of the developer temporary storage portion 121 provided in proximity to the developer delivery member 130 may be positioned lower than the rotating center of the feed auger 140 (see FIG. 2).

As shown in FIG. 3, the feed auger 140 may include a spiral axial-delivery blade 141 and a radial-delivery blade 142. The spiral axial-delivery blade 141 generates axial delivery force to deliver the developer, which is fed to the developer temporary storage portion 121, to the inlet 122 of the partition 120. The radial-delivery blade 142 generates radial delivery force to return a part of the delivered developer, having not been introduced into the inlet 122, to the developer delivery member 130.

In FIG. 4, reference numeral 160 indicates a shield member 160 which may be provided to shield the inlet 122 in an initial state of the developing device 40Y. A user may open the inlet 122, for example, by moving the shield member 160 from a side of the developing device 40Y. In an alternative embodiment, the shield member 160 may uncover the inlet 122 upon mounting the developing device or via operation of the developing device. In another alternative embodiment, the shield member 160 may be configured to cover or uncover the inlet 122 in linkage with an adjacent rotating member (for example, the feed auger 140 or circulating auger). If necessary, the shield member 160 may be provided with an elastic member (not shown) to enable an elastic opening or closing operation and a guide member (not shown) to guide movement of the shield member 160. Additionally, a sealing member (not shown) to prevent leakage of the developer may be provided near the shield member 160. When using the shield member 160, the shield member 160 is ideally larger than the inlet 122 in order to cover the inlet 122, and the present embodiment may of course be realized even if the shield member 160 is not provided as described.

Figure 5:
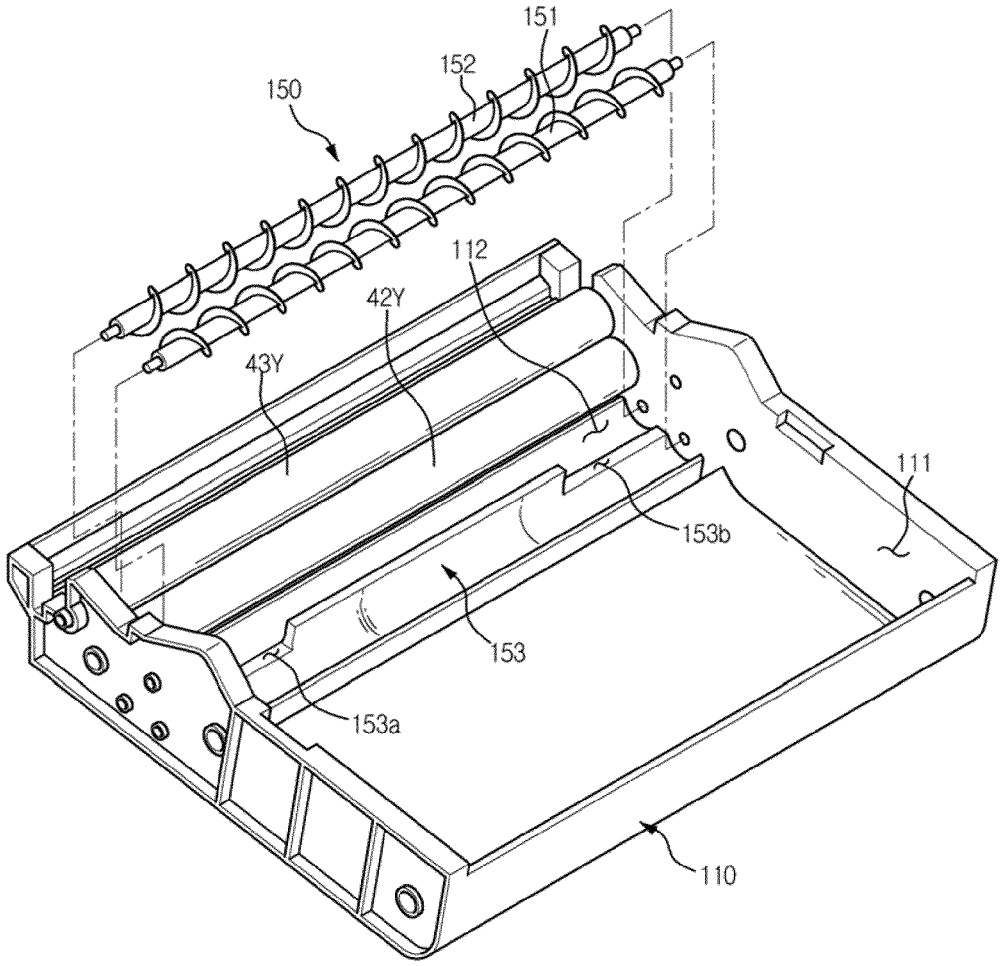
FIG. 5 is a perspective view illustrating an agitating member in accordance with the embodiment of FIG. 1.
Figure 6:
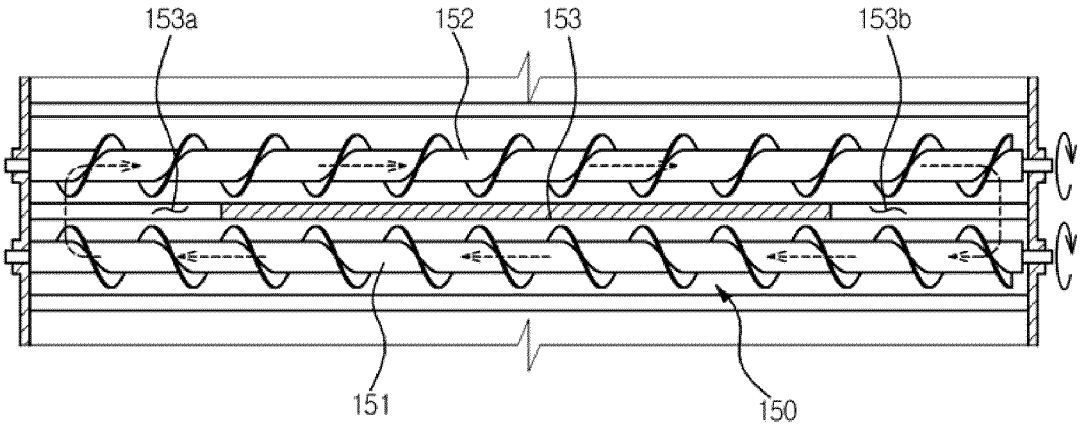
FIG. 6 is a plan view illustrating operation of the agitating member in accordance with the embodiment of FIG. 1.

FIG. 5 is a perspective view illustrating the agitating member 150 in accordance with the embodiment of FIG. 1, and FIG. 6 is a plan view illustrating operation of the agitating member 150 in accordance with the embodiment of FIG. 1.

As shown in FIGS. 5 and 6, the agitating member 150 may include a first circulating auger 151 to deliver the developer in one direction, and a second circulating auger 152 to deliver the developer in the other direction. Reference numeral 153 indicates a circulating wall provided between the first circulating auger 151 and the second circulating auger 152, the circulating wall 153 being provided with communication holes 153*a* and 153*b* at opposite sides thereof.

The developer, introduced into the second developer receiving chamber 112 through the inlet 122, circulates with the circulating wall 153 interposed therebetween. This circulation prevents solidification of the developer and achieves leveling of the developer, causing the developer to be evenly fed in a longitudinal direction of the feed tool 42Y.

This embodiment employs auger type feed elements, such as the feed auger 140, first circulating auger 151 and second circulating auger 152. However, in an alternative embodiment that will be described later herein, in addition to the auger type elements, any other developer feed member, developer agitating member and developing mixing member are also usable. In this case, peripheral configurations are slightly changeable according to shapes of the respective members, and this change is applicable equally by those skilled in the art.

Figure 7:
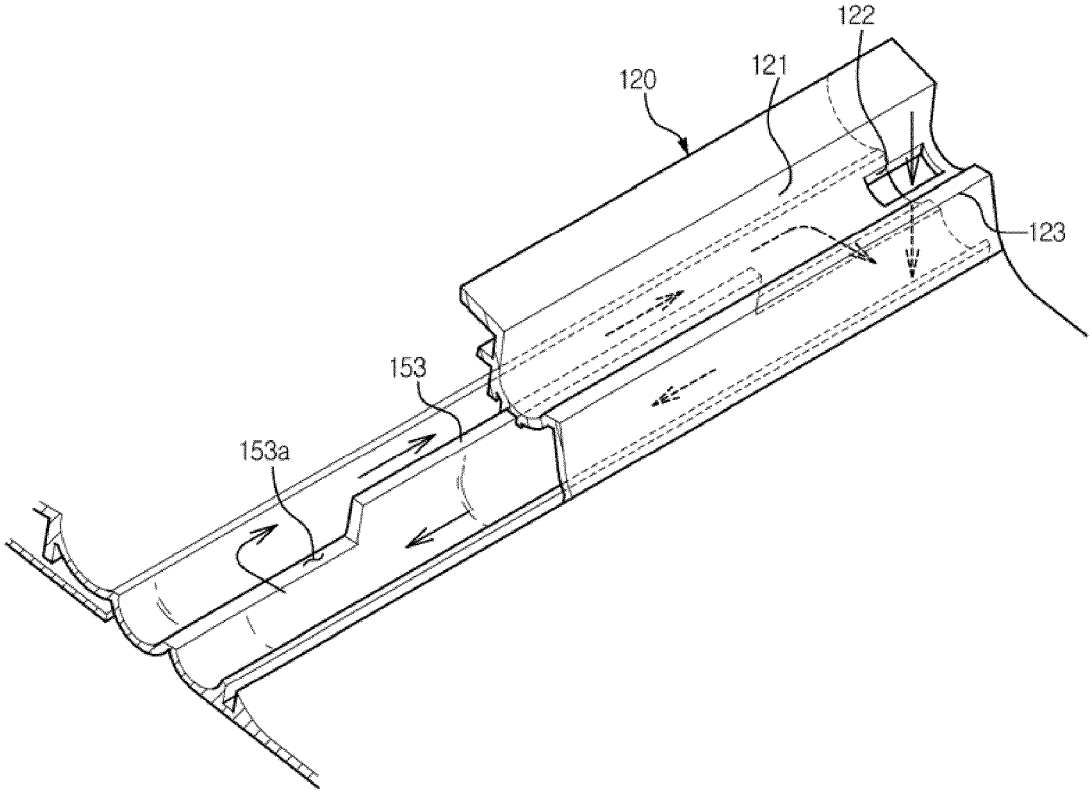
FIG. 7 is a view illustrating a developer delivery path in the developing device in accordance with the embodiment of FIG. 1.
Figure 8:
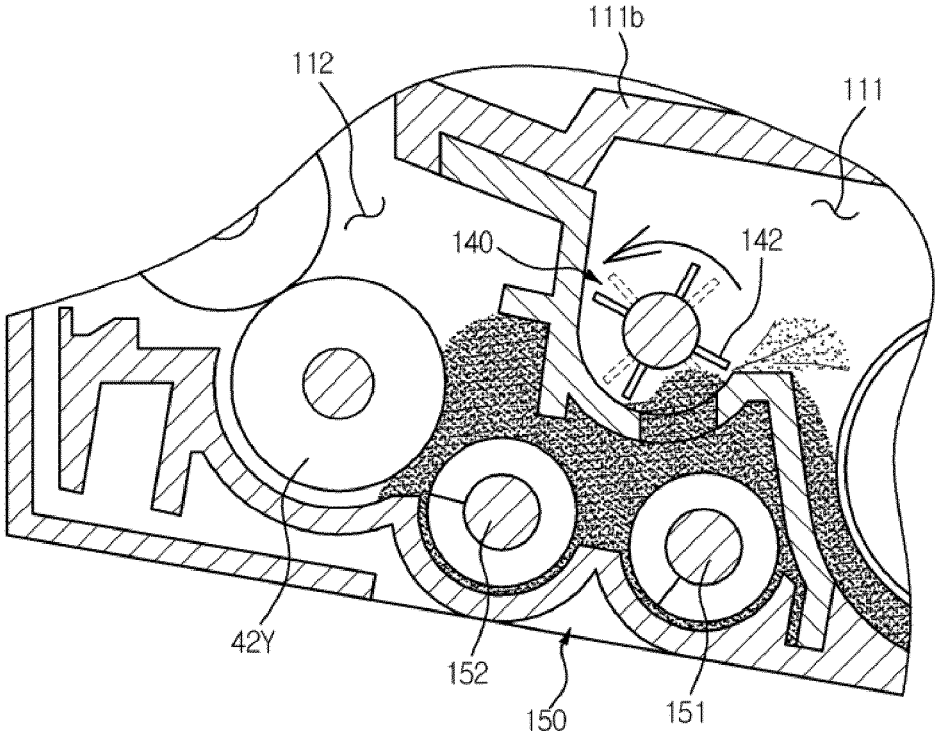
FIG. 8 is a sectional view of the periphery of the inlet in accordance with the embodiment of FIG. 1, illustrating a return operation of the developer fed into a developer temporary storage portion of the partition in a state wherein a sufficient amount of the developer is fed into a second developer receiving chamber.

FIG. 7 is a view illustrating a developer delivery path in the developing device 40Y in accordance with the embodiment of FIG. 1, and FIG. 8 is a sectional view of the periphery of the inlet 122 in accordance with the embodiment of FIG. 1, illustrating a return operation of the developer fed to the developer temporary storage portion 121 of the partition 120 in a state wherein a sufficient amount of the developer is fed into the second developer receiving chamber 112.

As shown in FIG. 7, the developer stored in the first developer receiving chamber 111 is delivered in the direction of the second developer receiving chamber 112, in this example upward relative to gravity, by the developer delivery member 130, to thereby be fed to the developer temporary storage portion 121. After being further delivered from the developer temporary storage portion 121 to a side of the partition 120 by the spiral axial-delivery blade 141 of the feed auger 140, the developer is introduced through the inlet 122 provided in a side of the developer temporary storage portion 121 by gravity. That is, the developer falls into the second developer receiving chamber 112 through the inlet 122.

The thus fallen developer may be fed to the feed tool 42Y by one or more circulating augers. More particularly, the present embodiment employs two circulating augers, and the developer is circulated by the first circulating auger 151 and second circulating auger 152 with the circulating wall 153 interposed therebetween. With this circulation, the developer is fed to the developing tool 43Y by way of the feed tool 42Y. Also, the use of more than two circulating augers is possible if desired.

Once a sufficient amount of the developer is fed into the second developer receiving chamber 112, the introduction of the developer through the inlet 122 may be stopped. As illustrated in FIG. 8, a part of the developer, having not been introduced into the inlet 122, may be returned toward the developer delivery member 130 by the radial-delivery blade 142 of the feed auger 140.

With the above-described configuration and operation, in the developing device of the present embodiment, the partition 120 achieves sequential feed and consumption of the developer, resulting in uniform print quality and effective use of the developer. More specifically, in the developing device 40Y of the present embodiment, the partition 120 prevents the developer which is deteriorated by peripheral pressure and temperature around the developing tool 43Y and feed tool 42Y from being returned into the first developer receiving chamber 111, and also causes sequential consumption of the developer around the developing tool 43Y and feed tool 42Y, thereby assuring uniform print quality. This also prevents high-quality developer from being mixed with the deteriorated developer and becoming useless, resulting in enhanced use efficiency of the developer.

The developing device in accordance with the present embodiment maintains an appropriate amount of the developer received in the second developer receiving chamber 112 without a separate sensor member. More specifically, in the developing device of the present embodiment, a part of all the developer stored in the first developer receiving chamber 111 is delivered in the direction of the second developer receiving chamber 112, in this example upward relative to gravity, to thereby fall through the inlet 122 by gravity. If the developer fed into the second developer receiving chamber 112 accumulates to the vicinity of the inlet 122, the developer is not further fed through the inlet 122, but is returned to the developer delivery member 130, thus causing the developer received in the second developer receiving chamber 112 to always maintain a predetermined level. In the present embodiment, furthermore, the feed auger 140 may include the radial-delivery blade 142 provided at the inlet 122, enabling a more efficient return of the developer in the developing device 40Y.

In the present embodiment, a thrust force of the feed auger 140 and a load of the developer stored in the first developer receiving chamber 111 have no effect on the inlet 122. This not only prevents an excessively great amount of the developer from being fed into the second developer receiving chamber 112, but also minimizes deterioration of the developer caused in the course of introducing the developer into the second developer receiving chamber 112.

In a state in which the developing device 40Y is mounted in the body of the image forming apparatus (see FIG. 1), the bottom plane 111*a* of the first developer receiving chamber in accordance with the present embodiment may be inclined. Accordingly, the developer in the first developer receiving chamber 111 is concentrated on a side that is opposite of the partition 120 by gravity, and substantially no pressure due to a load of the developer is applied to the inlet 122 even if the first developer receiving chamber 111 is filled with a great amount of the developer. In this case, an inclination angle $\alpha$ of the bottom plane 111*a* may be in the range of approximately 2 to 5 degrees. If the inclination angle $\alpha$ of the bottom plane 111*a* is less than 2 degrees, it may be difficult to efficiently prevent a load of the developer from being concentrated on the inlet 122. If the inclination angle $\alpha$ of the bottom plane 111*a* is more than 15 degrees, there is a risk of excessive gravitational stress being applied to the developer concentrated on the side that is opposite of the partition 120, thus impeding effective delivery of the developer to the feed tool 42Y.

Hereinafter, alternative embodiments of the present general inventive concept will be described with reference to the accompanying drawings. For reference, if there is no citation or description of certain features, the above-described descriptions and reference numerals will be equally applied in the following description.

Figure 9A:
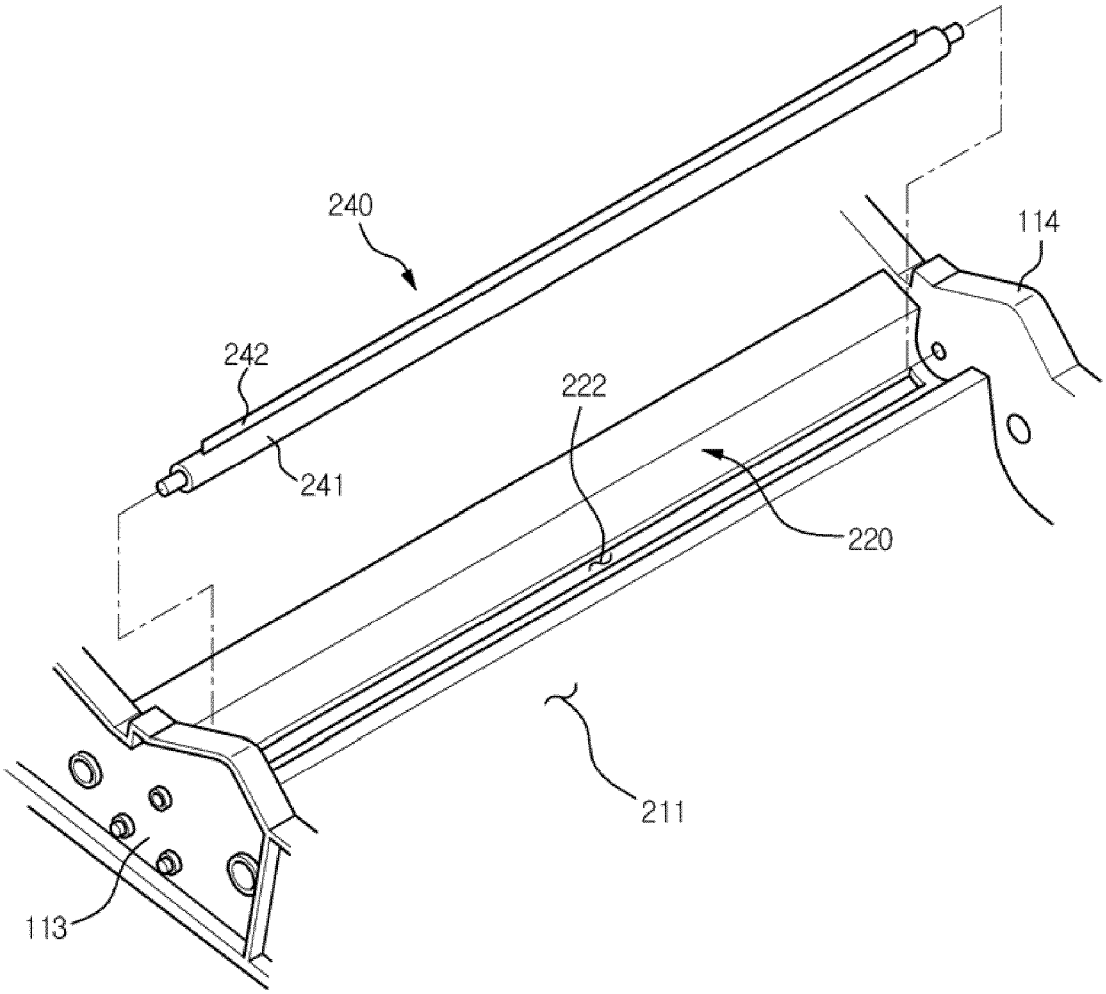
FIG. 9A is a perspective view illustrating a partition and a return member provided in a developing device in accordance with another embodiment of the present general inventive concept.
Figure 9B:
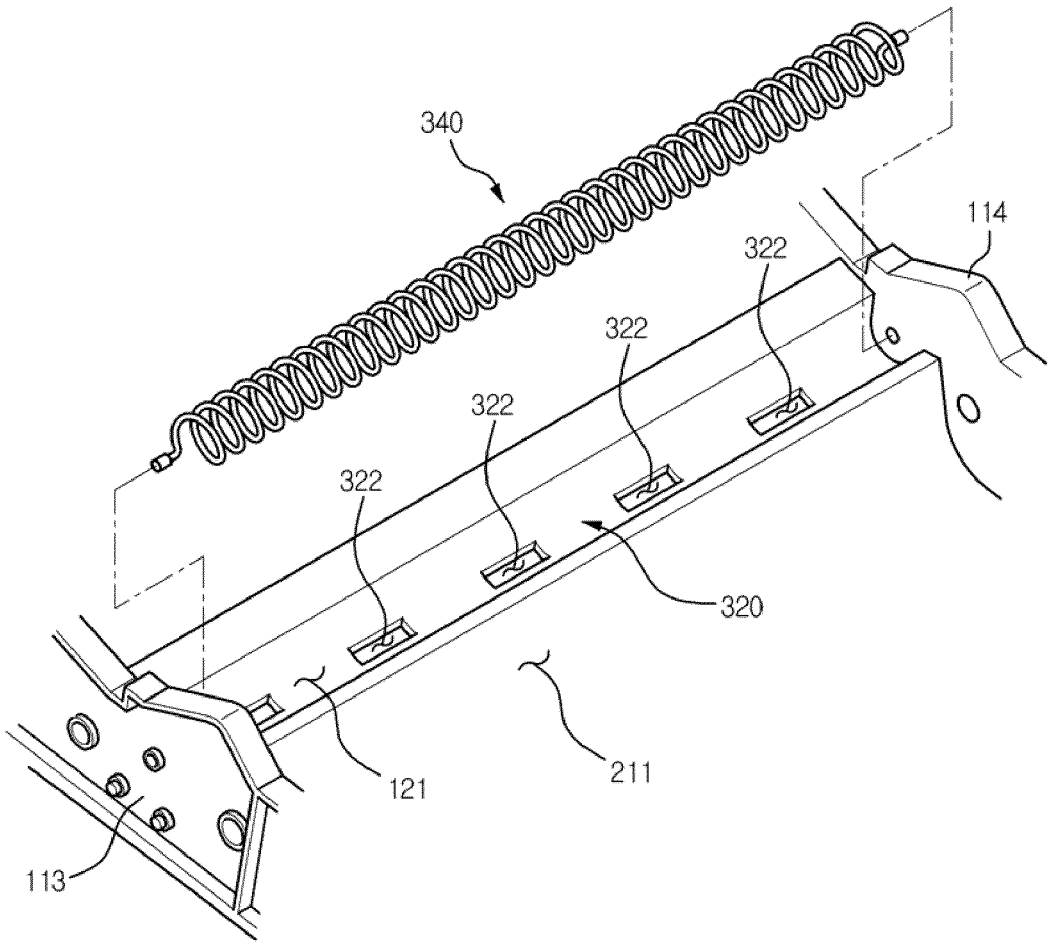
FIG. 9B is a perspective view illustrating a partition and an agitating member provided in a developing device in accordance with still another embodiment of the present general inventive concept.

FIG. 9A is a perspective view illustrating a partition and a return member provided in a developing device in accordance with another embodiment of the present general inventive concept, and FIG. 9B is a perspective view illustrating a partition and an agitating member provided in a developing device in accordance with still another embodiment of the present general inventive concept.

As illustrated in FIG. 9A, in this embodiment, an inlet 222 provided in a partition 220 may have form of a slit extending in a longitudinal direction of the partition 220 from a left sidewall 113 to a right sidewall 114 of a developing device. The developer, delivered in the first developer receiving chamber 211 in the direction of a second developer receiving chamber by the developer delivery member, falls through the slit-shaped inlet 222.

The developing device of the present embodiment may further include a return member 240 arranged above the inlet 222 to return a part of the developer, having not been introduced into the inlet 222, in the direction of the developer delivery member. The return member 240 may include a rotating shaft 241, and a return blade 242 attached to an outer periphery of the rotating shaft 241. Of the developer delivered in the first developer receiving chamber 211 in the direction of the second developer receiving chamber by the developer delivery member, some developer having not been introduced into the inlet 222 is returned in the direction of the developer delivery member by the return member 240.

In FIG. 9B, which illustrates still another embodiment of the present general inventive concept, a partition 320 is provided with a plurality of inlets 322 arranged in a longitudinal direction of the partition 320. Once the developer is delivered to the developer temporary storage portion 121, the developer is fed into the second developer receiving chamber 122 through the inlets 322 at a uniform rate in a direction substantially transverse to the direction of the developer feed.

A spiral agitating member 340 may be provided at the developer temporary storage portion 121. If the developer is delivered in the first developer receiving chamber 111 in the direction of the developer temporary storage portion 121 by the developer delivery member, the agitating member 340 agitates the developer, causing the developer to be uniformly distributed in a direction substantially transverse to the direction of the developer feed.

As illustrated in FIGS. 9A and 9B, there is no limit in the number and shape of the inlets, and the inlets may be altered in various manners. In addition, various shapes of other members, such as the feed auger 140 of the first embodiment, the return member 240 of the second embodiment and the agitating member 340 of the third embodiment, may be provided above the inlets based on the number and shape of the inlets, thereby implementing operations to deliver the developer to the inlets, to level the developer, and/or to return the developer to the developer delivery member. Of course, the feed auger 140, return member 240, etc., described herein are given only by way of example, and various other shapes of members may also be installed.

Figure 10:
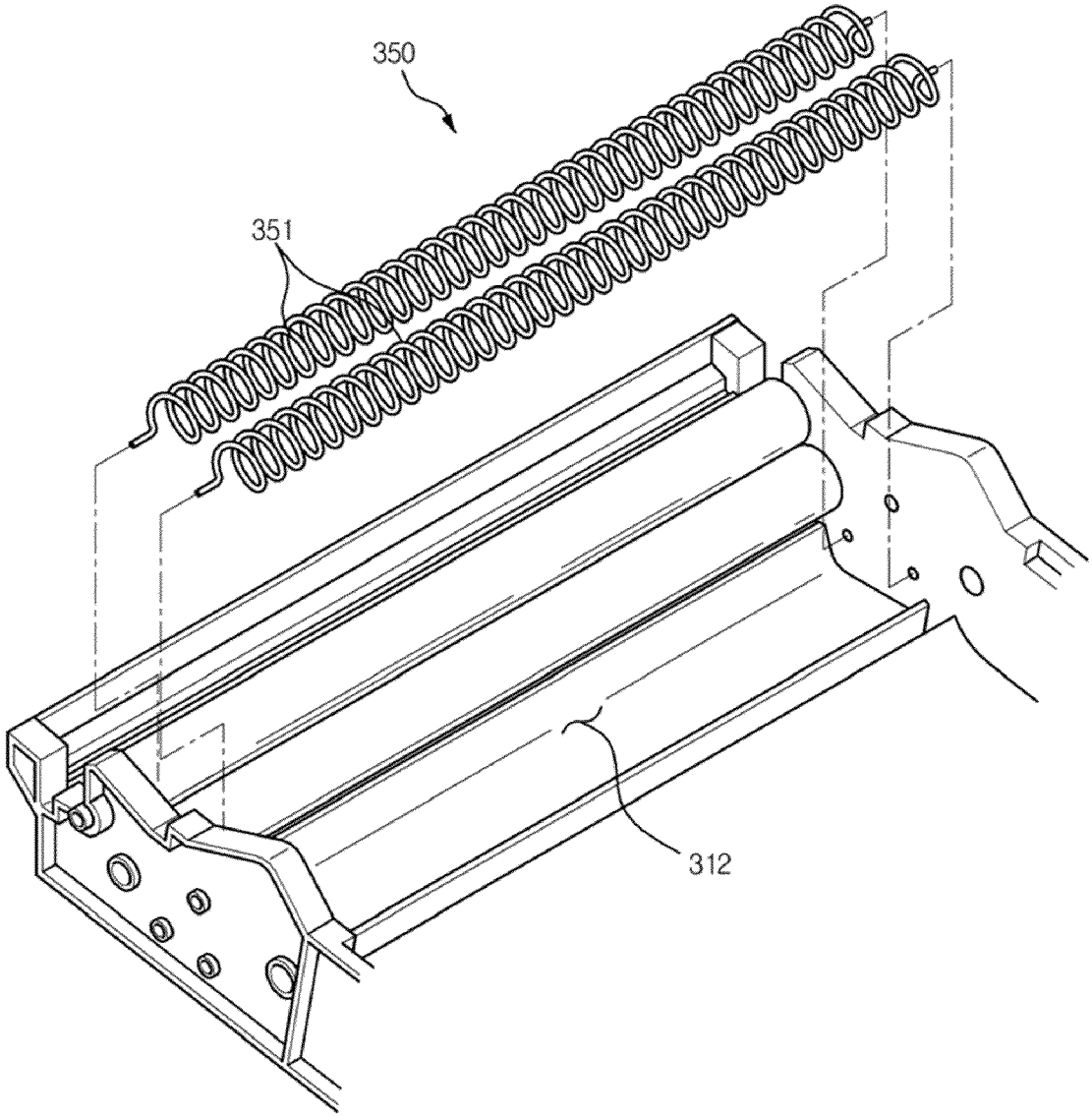
FIG. 10 is a perspective view showing an agitating member provided in a second developer receiving chamber in accordance with yet another embodiment of the present general inventive concept.

FIG. 10 is a perspective view illustrating an agitating member provided in a second developer receiving chamber in accordance with yet another embodiment of the present general inventive concept.

An agitating member 350 in accordance with the present embodiment includes a spiral coil 351. The spiral coil 351 may be rotatably provided in a second developer receiving chamber 312 to prevent solidification of the developer fed into the second developer receiving chamber 312 and to level the developer.

Of course, the agitating members described herein are given by way of example, and may be altered into various shapes other than the above-described auger and spiral shapes, and various quantities of the agitating members may also be provided.

As is apparent from the above description, the embodiments of the present general inventive concept provide a developing device having an improved developer delivery configuration.

While various embodiments of the present general inventive concept have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the present general inventive concept.

What is claimed is:

1. A developing device to be mounted in an image forming apparatus the developing device comprising:

a feed tool to feed a developer to a developing tool via a frictional charging force;

a developer receiving chamber in which developer is stored an endless belt disposed in the developer receiving chamber and rotatable with respect to a first rotational member and a second rotational member, a first delivery unit to receive developer supplied via the endless belt; and a second delivery unit to receive developer supplied via the first delivery unit, the second delivery unit arranged so that the first delivery unit is higher than the second delivery unit in a state in which the developing device is mounted in a body of the image forming apparatus, wherein developer is delivered to the feed tool by the second delivery unit, wherein the endless belt is disposed between the first rotational member and the second rotational member and is inclined when the developing device is mounted in the image forming apparatus, so as to move developer along an inclined conveying path.

2. The developing device according to claim 1, further comprising:

a partition to divide the developer receiving chamber into a first developer receiving chamber and a second developer receiving chamber, wherein the first delivery unit and second delivery unit are provided higher and lower than the partition, respectively.

3. The developing device according to claim 2, wherein the partition includes a first partition portion provided between the first delivery unit and the second delivery unit, and a second partition portion extending substantially downward from the first partition portion.

4. The developing device according to claim 3, further comprising:

an inlet formed in the first partition portion, wherein the developer delivered by the first delivery unit is fed to the second delivery unit through the inlet.

5. The developing device according to claim 4, wherein the first partition portion substantially surrounds a lower part of the first delivery unit.

6. The developing device according to claim 4, wherein the inlet is formed at an end of the partition portion.

7. The developing device according to claim 6, wherein the first delivery unit includes a spiral delivery blade to deliver the developer to the inlet and a radial delivery blade to return a part of the developer that does not enter the inlet,

8. The developing device according to claim 4, wherein the inlet of the partition is located lower than a nip region between the feed tool and the developing tool.

9. The developing device according to claim 4, further comprising:

a shield member to selectively shield the inlet of the partition.

10. The developing device according to claim 3, wherein the second partition portion limits return of the developer to be delivered from the first delivery unit to the second delivery unit.

11. The developing device according to claim 2, wherein a bottom plane of the first developer receiving chamber is inclined in response to the developing device being mounted in the image forming apparatus, causing the developer received in the first developer receiving chamber to be concentrated on an area opposite to the partition.

12. The developing device according to claim 11, wherein the bottom plane of the first developer receiving chamber has an inclination angle in the range of approximately 2 degrees to approximately 5 degrees in response to the developing device being mounted in the image forming apparatus.

13. The developing device according to claim 1, wherein the second delivery unit includes a first circulating auger and a second circulating auger, and the developing device further comprises a circulating wall provided between the first circulating auger and the second circulating auger and having communication holes formed at opposite sides thereof.

14. A developer feeding method of a developing device including a feed tool to feed a developer to a developing tool and a developer receiving chamber in which developer is stored, and an endless belt disposed in the developer receiving chamber and rotatable with respect to a first rotational member and a second rotational member, wherein the endless belt is disposed between the first rotational member and the second rotational member and is inclined when the developing device is mounted in the image forming apparatus, so as to move developer alone an inclined conveying path, the method comprising:

delivering a part of the developer received in the developer receiving chamber upward along the inclined conveying path of the developer receiving chamber via the endless belt;

causing free fall of a first Part of the developer delivered upward; and feeding the fallen developer to the feed tool.

15. The method according to claim 14, wherein the developing device includes a first delivery unit and a second delivery unit arranged so that the first delivery unit is higher than the second delivery unit in a state in which the developing device is mounted in an image forming apparatus.

16. The method according to claim 15, wherein the developing device further includes a partition to divide the developer receiving chamber into a first developer receiving chamber and a second developer receiving chamber, and the first delivery unit and second delivery unit are provided higher and lower than the partition, respectively.

17. The method according to claim 16, wherein the developing device further includes an inlet formed in the partition, and the developer delivered upward in the direction of gravity is delivered to the inlet of the partition by the first delivery unit and is delivered to the second delivery unit through the inlet.

18. A developing device of an image forming apparatus, comprising;

a feed tool to feed a developer to a developing tool;

a developer receiving chamber in which developer is stored, the developer receiving chamber including a first developer receiving chamber and a second developer receiving chamber;

a first delivery unit disposed in the first developer receiving chamber to deliver the developer to the feed tool;

a second delivery unit disposed in the second developer receiving chamber to deliver developer to a point higher than the first delivery unit; and an endless, belt disposed in the second developer receiving chamber and rotatable with respect to a first rotational member and a second rotational member, wherein the endless belt is disposed between the first rotational member and the second rotational member and is inclined when the developing device is mounted in the image forming apparatus, so as to move developer along an inclined conveying path to the second delivery unit.

19. The developing device of claim 18, wherein at least part of the developer delivered by the second delivery unit falls toward the first delivery unit.

20. The developing device of claim 19, further comprising:

a partition between the first and second delivery units.

21. The developing device of claim 20, wherein at least one inlet is provided in the partition, the at least part of the developer falling to the first delivery unit through the at least one inlet.

22. The developing device of claim 21, further comprising:

a developer moving portion provided at the second delivery unit to move the developer delivered by the second delivery unit toward the at least one inlet.

23. The developing device of claim 19, further comprising:

a return part provided at the second delivery unit to return a portion of the developer that does not fall to the first delivery unit.

24. A developing device to be mounted in an image forming apparatus comprising:

a first delivery unit to deliver a developer stored in a lower portion of a first developer receiving chamber, wherein the first delivery unit is an endless belt disposed in the first developer receiving chamber and rotatable with respect to a first rotational member and a second rotational member, wherein the endless belt is disposed between the first rotational member and the second rotational member and is inclined when the developing device is mounted in the image forming apparatus, so as to move developer along an inclined conveying path;

a second delivery unit disposed in an upper portion of the first developer receiving chamber, to receive the developer delivered by the first delivery unit, to feed a first portion of the developer to a second developer receiving chamber, and to return a second portion of the developer to the lower portion of the first developer receiving chamber; and a partition to divide the first developer receiving chamber and the second developer receiving chamber, wherein the second delivery unit is disposed above the partition and feeds the first portion of the developer downward through an opening in the partition to the second developer receiving chamber.

25. A developing device to be mounted in an image forming apparatus, the developing device comprising:

a feed tool to feed developer to a developing tool via a frictional charging force; a developer receiving chamber in which developer is stored;

an endless belt disposed in the developer receiving chamber and rotatable with respect to a first rotational member and a second rotational member;

a first delivery unit to receive developer supplied via the endless belt; and a second delivery unit to receive developer supplied via the first delivery unit, the second delivery unit arranged so that the first delivery unit is higher than the second delivery unit in a state in which the developing device is mounted in a body of the image forming apparatus, wherein developer is delivered to the feed tool by the second delivery unit, wherein a plane extending between a first rotational axis of the first rotational member and a second rotational axis of the second rotational member is inclined when the developing device is mounted in the image forming apparatus such that the endless belt is inclined when the developing device is mounted in the image forming apparatus.

26. A developing device mountable in an image forming apparatus, the developing device comprising:

a developing roller;

a feed roller to feed developer to the developing roller; a developer receiving chamber in which developer is stored;

a feed member disposed in the developer receiving chamber to move developer in a first conveying direction;

a first delivery unit to receive developer supplied via the feed member; and a second delivery unit to receive developer supplied via the first delivery unit and to supply the received developer to the feed roller, wherein the second delivery unit comprises a first auger capable of moving developer in a second conveying direction that is perpendicular to the first conveying direction and a second auger capable of moving developer in a third conveying direction that is parallel and opposite to the second conveying direction, wherein the feed member comprises an endless belt disposed in the developer receiving chamber and rotatable with respect to a first rotational member and a second rotational member, and the endless belt is disposed between the first rotational member and the second rotational member and is inclined when the developing device is mounted in the image forming apparatus, so as to move developer along an inclined conveying path.

27. The developing device of claim 26, wherein the first delivery unit comprises a third auger to deliver developer to the second delivery unit through an inlet.

28. The developing device of claim 26, wherein the second delivery unit is arranged so that the first delivery unit is higher than the second delivery unit in a state in which the developing device is mounted in a body of the image forming apparatus.

* * * * *